United States Patent [19]

Piper

[11] Patent Number: 4,575,713

[45] Date of Patent: Mar. 11, 1986

[54] DISTURBANCE ALARM

[76] Inventor: Bert W. Piper, 850 Old Post Rd., Port Richey, Fla. 33568

[21] Appl. No.: 605,552

[22] Filed: Apr. 23, 1984

[51] Int. Cl.[4] ..... G08B 13/08

[52] U.S. Cl. ..... 340/546; 340/545; 340/689

[58] Field of Search ..... 340/546, 566, 689, 690, 340/545, 547; 200/61.52, 61.45 R, 61.45 M

[56] References Cited

U.S. PATENT DOCUMENTS 4,100,539 7/1978 Stahl et al. ..... 340/546

4,168,495 9/1979 Sweeney ..... 340/546

*Primary Examiner*—James L. Rowland

*Assistant Examiner*—Chi K. Lau

*Attorney, Agent, or Firm*—Barnes, Kisselle, Raisch, Choate, Whittemore & Hulbert

[57] ABSTRACT

A disturbance alarm comprising a hollow tubular case having upper and lower electrical contact plates fixedly positioned therein. A pendulum assembly includes a lower weight which rests upon the flat upper surface of the lower contact plate, an upper weight and a rigid shaft fixed to the weights and spacing the weights from each other. The upper electrical contact plate encircles the pendulum shaft and is adapted to make electrical contact therewith to close an electrical circuit through an alarm device. A collar is slidable within the case for clamping the lower weight onto the contact plate such that the pendulum is balanced thereon out of electrical contact with the upper contact plate. A magnet encircles the pendulum shaft adjacent to the upper weight for attracting and holding the pendulum in electrical contact with the upper plate when such balance is disturbed and an alarm condition is thereby detected.

7 Claims, 3 Drawing Figures

DISTURBANCE ALARM

The present invention is directed to burglar alarms, and more particularly to alarm devices of a type adapted to be mounted on doors, windows or the like so as to detect disturbance thereof and audibly indicate an alarm condition.

It is an object of the present invention to provide a disturbance alarm which is economical to manufacture, contains few moving parts, is portable, may be easily installed and readily operated by unskilled personnel, and is readily adapted for use in a variety of applications in the home, such as on doors or windows.

The invention, together with additional objects, features and advantages thereof, will be best understood from the following description, the appended claims and the accompanying drawing in which:

Figure 1:
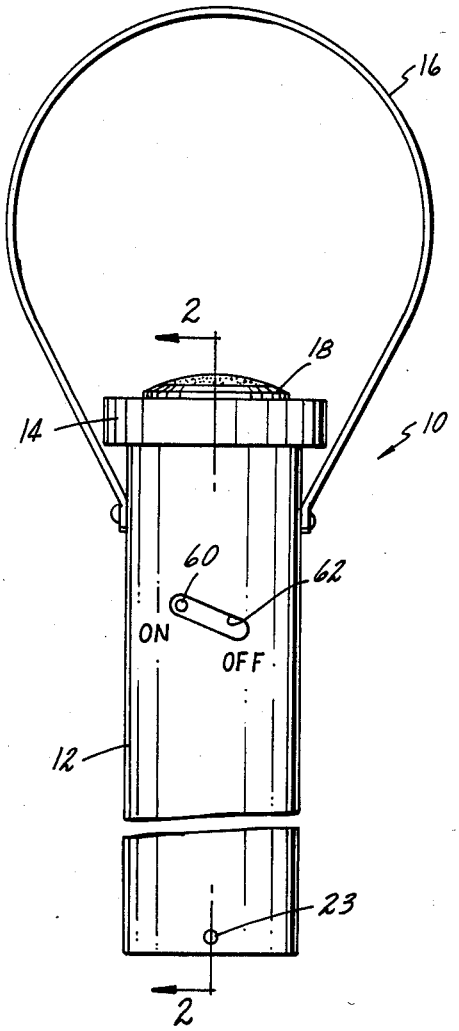
FIG. 1 is a broken front elevational view of a presently preferred embodiment of a disturbance alarm provided in accordance with the present invention.
Figure 2:
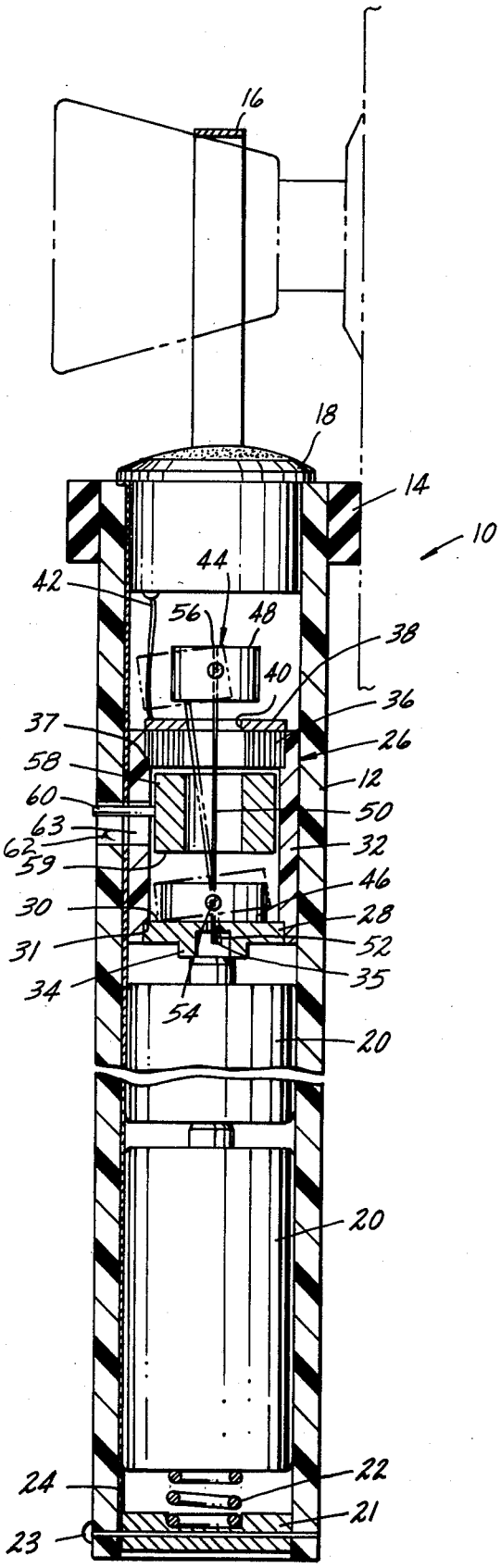
FIG. 2 is a broken sectional view on an enlarged scale taken substantially along the line 2—2 in FIG. 1.

The drawing illustrates a presently preferred embodiment 10 of a disturbance alarm in accordance with the invention as comprising a hollow tubular case 12 externally encircled at its upper end by a rubber bumper 14 and having a strap 16 fixed thereto for suspending alarm 10 from a doorknob, for example, as illustrated in phantom in FIG. 2. The upper end of case 12 is closed by an audible alarm device 18, such as a buzzer or bell, which is responsive to electrical energy. A pair of flashlight batteries 20 are telescopically received and electrically connected in series within the lower end of case 12. A conductive end cap 21 is removably affixed by the pin 23 within the lower end of case 12 and is electrically connected to the housing of alarm device 18 by the conductive metal strip 24 which extends lengthwise along the inside wall surface of case 12. A coil spring 22 is positioned between the negative terminal of the lower battery 20 and end cap 21.

Positioned within case 12 between batteries 20 and alarm device 18 is a subassembly 26 which includes the disturbance detector of the present invention. A lower electrical contact plate 28 having a flat upper surface 30 is press-fitted into a sleeve 32 against the shoulder 31 and has a downwardly projecting central boss 34 in electrical contact with the positive terminal of the upper battery 20. Boss 34 is formed with a central cavity 35. An annular magnet 36 is press-fitted into the opposing or upper end of sleeve 32 against the shoulder 37 and exhibits an axially oriented magnetic field which is substantially circumferentially uniform around the axis of sleeve 32. A second electrical contact plate 38 is affixed to the face of magnet 36 remote from contact plate 28 and has a central opening 40 of lesser diameter than the central opening of magnet 36. Contact plate 38 is electrically connected by the conductor 42 to the power terminal of alarm device 18. Sleeve 32 is pressfitted within case 12 such that plate boss 34 contacts the positive terminal of upper battery and spring 22 is in compression between the lower battery and end cap 22. Sleeve 32 and case 12 are preferably of plastic construction.

A.pendulum assembly 44 includes a lower weight 46, an upper weight 48, and a rigid wire shaft 50 affixed to and extending between lower and upper weights 46,48. At least lower weight 48 and shaft 50, and preferably also upper weight 48, are constructed of electrically conductive material. Shaft 50 is constructed of ferromagnetic material. Brass is a suitable material for contact plates 28,36 and weights 46,48. Shaft 50 is of steel construction. Lower weight 46 has a diameter which is less than the inside diameter of sleeve 32, preferably a uniform axial thickness and a flat lower surface which loosely rests in assembly on upper surface 30 of contact plate 28. Upper weight 48, which is cylindrical and preferably of uniform thickness, is carried and supported in assembly above upper contact plate 38 by wire shaft 50 which extends through contact plate opening 40. It will be noted in particular that shaft 50 projects through lower weight 46 and through a central aperture 52 in contact plate 28 into cavity 35. Aperture 52 is only slightly larger than the diameter of shaft 50 so as to permit the shaft to assume the broken line position shown in FIG. 2. When weight 46 rests flatly on plate 28, the interengagement of shaft 50 and aperture 52 positions lower weight 46 and pendulum 44 centrally of contact plate 28 and case 12. Weights 46,48 are adjustably affixed to associated ends of wire shaft 50 by the respective set screws 54,56.

Figure 3:
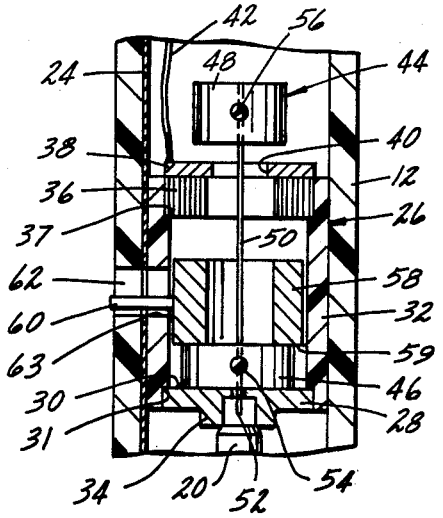
FIG. 3 is a fragmentary sectional view of a portion of the alarm shown in FIG. 2 which illustrates the reset and locked position thereof.

A collar 58 encircling shaft 50 and having a flat lower end face 59 is slidably captured within sleeve 32 between magnet 36 and lower weight 46. The inside diameter of collar 58 is less than the outside diameter of lower weight 46. A pin 60 projects radially outwardly from collar 58 through aligned part-spiral slots 62,63 in case 12 and sleeve 32. Collar 58 is adapted to engage lower weight 46, as shown in FIG. 3, at the lower position of pin 60 in slots 62,63 so as to clamp weight 46 in flatwise engagement against surface 30 of contact plate 28. In this position of sleeve 58 (FIG. 3), upper weight 48, lower weight 46 and wire shaft 50 are vertically concentric with magnet 36 and upper contact plate 38. In this position of collar 58, alarm 10 is effectively turned off and locked. Alarm 10 may then be suitably conditioned for disturbance detection with wire shaft 50 and the axis of case 12 oriented vertically.

To activate alarm 10, collar 58 is carefully moved to its upper position illustrated in FIG. 2 by slowly sliding pin 60 to the uppermost position within slots 62,63. If case 12 is disturbed such that inertia of upper weight 48 causes the weight to be effectively positioned off-axis, magnetic attraction of shaft 50 to magnet 36 is sufficient to tilt pendulum 44 to the position illustrated in phantom lines in FIG. 2, whereby the electrical circuit to alarm 18 is closed by contact of shaft 50 with upper contact plate 38. It will be noted that wire shaft 50 is sufficiently stiff as to remain substantially straight and thereby cant lower weight 46 on edge on plate 28. It will also be noted that the diameter of upper weight 48 is sufficiently less than the inside diameter of case 12 as to allow contact of shaft 50 against contact plate 38 (phantom in FIG. 2) before weight 48 touches case 12. Magnet 36 holds pendulum 44 in the alarm-activating condition until such time as collar 58 is moved to the position of FIG. 3 to turn off the alarm. At this time, the stiffness of wire shaft 50 returns upper weight 48 to the central balanced position. The length of the portion of wire 50 projecting through aperture 52 is sufficient to prevent disengagement thereof when the case 12 is inverted.

It will thus be appreciated that the disturbance detector and alarm of the invention is economical to manufacture and easy to operate. It will also be noted that the detector is responsive to a very slight disturbance in any lateral direction, since pendulum 44 is free to tilt or cant in any direction. In the locked condition (FIG. 3), there is no drain on battery power, and the detector may be carried, rested or stored on its side since wire shaft 50 is sufficiently stiff to maintain shaft 50 out of contact with plate 38.

The invention claimed is:

1. A disturbance alarm comprising a case adapted to be positioned in vertical orientation; first electrical contact means disposed in fixed position within said case and having a contact face which is oriented upwardly in vertical orientation of said case; a pendulum assembly comprising a lower weight of electrically conductive material resting upon said contact face in vertical orientation of said case, an upper weight and a rigid shaft of electrically conductive material affixed to and extending between said upper and lower weights to support said upper weight above and spaced from said lower weight for tilting motion within said case; second electrical contact means affixed within said case, spaced from said first contact means and encircling said pendulum assembly adjacent to said upper weight; alarm means responsive to electric power; electrical circuit means including a source of electric power connected through said alarm means to said first and second contact means; and means for positioning said lower weight on said contact face such that said pendulum assembly is balanced on said lower contact face in vertical orientation of said case with said shaft and upper weight spaced from said second contact means, disturbance of said case unbalancing said pendulum assembly such that said pendulum assembly contacts said second contact means and thereby completes an electrical circuit through said alarm and said source of electrical power.

2. The disturbance alarm set forth in claim 1 wherein said shaft is of ferromagnetic construction, and wherein said detection further comprises magnet means encircling said pendulum assembly adjacent to said second contact means for attracting and holding said pendulum assembly against said second contact means in the event of a said disturbance.

3. The disturbance alarm set forth in claim 2 wherein both said upper contact face and the opposed face of said lower weight are of planar construction.

4. The disturbance alarm set forth in claim 3 wherein said first contact means includes a central aperture, and wherein said shaft projects through said lower weight into said aperture for positioning said lower weight centrally of said first contact means.

5. The disturbance alarm set forth in claim 3 wherein said positioning means comprises means movably mounted within said case between said lower weight and said second electrical contact means, and means for selectively moving said movably-mounted means into and out of clamping engagement with said lower weight against said first contact means.

6. The disturbance alarm set forth in claim 5 wherein said movably-mounted means comprises a collar surrounding said shaft and slidably disposed within said case; and wherein said selectively-moving means comprises a part-spiral opening in said case, and means coupled to said collar and projecting through said opening.

7. A disturbance alarm comprising a case; first electrical contact means fixedly mounted within said case; a pendulum comprising a weight, a shaft of electrically conductive and magnetically permeable material affixed at one end to said weight; and means at the opposing end of said shaft electrically connecting said shaft to said first electrical contact means and mounting said shaft with respect to said first electrical contact means such that said weight is supported by said shaft to swing laterally within said case; second electrical contact means affixed within said case surrounding said shaft; a magnet fixedly positioned within said case encircling said shaft; alarm means responsive to electrical power; electrical circuit means including a source of electrical power connected to said first and second contact means through said alarm means; and means for selectively positioning said weight with respect to said magnet such that magnetic forces on said shaft are balanced and said pendulum is spaced from said second contact means, inertia of said weight being such that disturbance of said case unbalances said magnetic forces, attracting and holding said shaft and closing an electrical circuit through said shaft and second contact means so as to energize said alarm.

* * * * *